United States Patent [19]

Hibino

[11] Patent Number: 4,580,917

[45] Date of Patent: Apr. 8, 1986

[54] PAPER FEED APPARATUS FOR PRINTER

[75] Inventor: Ikuo Hibino, Iwate, Japan

[73] Assignee: Alps Electric Co. Ltd., Japan

[21] Appl. No.: 657,216

[22] Filed: Oct. 3, 1984

[30] Foreign Application Priority Data

Oct. 3, 1983 [JP] Japan ..... 58-153659[U]

[51] Int. Cl.[4] ..... B41J 13/03

[52] U.S. Cl. ..... 400/636; 400/636.2; 400/656; 400/120; 400/314

[58] Field of Search ..... 400/569, 636, 314, 570, 400/568, 314.2, 314.6, 185, 187, 636.2, 641, 617, 323, 120, 656

[56] References Cited

U.S. PATENT DOCUMENTS 2,667,256 1/1954 Madsen ..... 400/570
4,030,588 6/1977 Hanagata et al. .
4,050,569 9/1977 Crump et al. ..... 400/569 X
4,217,057 8/1980 Nakamura ..... 400/636.2 X
4,345,708 8/1982 Hubbard ..... 400/559.1 X

FOREIGN PATENT DOCUMENTS 188388 11/1982 Japan ..... 400/185

*Primary Examiner*—Charles A. Pearson
*Attorney, Agent, or Firm*—Guy W. Shoup

[57] ABSTRACT

A paper feed apparatus has two partially toothed gears which are separately provided on a drive shaft and which rotate corresponding to the opposite ends of the displacement path of a carriage, and a driven gear rotating together with a paper feed roller which is driven by the toothed gears. The paper feeding amount can be desiredly set by setting the mounting angular position of the partially toothed gears with respect to the drive shaft.

7 Claims, 12 Drawing Figures

PAPER FEED APPARATUS FOR PRINTER

BACKGROUND OF THE INVENTION

1. Field of the Invention

The present invention relates to a printer such as a thermal printer, etc., and particularly to a paper feed apparatus in which a paper feed roller is rotated by a predetermined angle in synchronism with the reciprocal movement of a printing head.

2. Description of Prior Art

In many conventional printers, the operation of movement of a printing head and the operation of paper feeding are respectively performed by separately provided power sources. Accordingly, the printer is large in its entire volume.

It has been proposed in such printers to drive the paper feed roller by the drive source for driving the printing head. In the conventional printer of this kind, however, there is a disadvantage that the movement of the printing head and the rotation of the paper feed roller are interlocked by a predetermined power transmission mechanism which is uniform so that the pitch of paper feeding cannot be desiredly set, cannot be finely adjusted and varies between printers.

SUMMARY OF THE INVENTION

An object of the present invention is to eliminate the above-mentioned disadvantage in the prior art.

Another object of the present invention is to provide a paper feed apparatus in which the paper feed amount can be desiredly set in a printer in which the drive of a printing head and the drive of a paper feed roller are performed by a common drive source.

To attain the above-mentioned objects, according to an aspect of the invention, the paper feed apparatus for a printer comprises: a printer head opposed to a platen; a paper feed roller for feeding a recording paper to the platen; a driven gear interlocked with the paper feed roller; a clutch mechanism for transmitting the rotation in one direction of the driven gear to the paper feed roller; a drive shaft arranged to be rotated in one or the other directions by a predetermined angle when the printing head travels to the opposite ends of its reciprocation path; and a first and a second toothed means separately mounted on the drive shaft, the first toothed means being arranged such that it engages with the driven gear when the printing head reaches one end of its reciprocation path, and the second toothed means being arranged such that it engages with the driven gear when the printing head reaches the other end of its reciprocation path.

According to the present invention, the angular position, with respect to the drive shaft, of each of the first and second toothed means is adjustable.

According to the present invention, the amount of paper feeding by the paper feed roller is changeable by changing the angular position of each of the first and second toothed means with respect to the drive shaft.

These and other objects, advantages, features, and uses will become more apparent as the description proceeds, when considered with the accompanying drawings.

DETAILED DESCRIPTION OF PREFERRED EMBODIMENT

Figure 1:
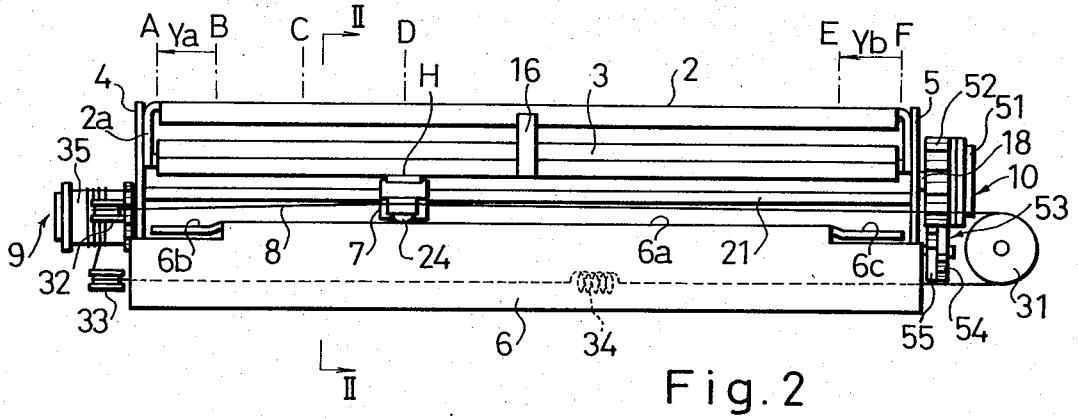
FIG. 1 is a plan view of a printer of the invention.

Referring to the drawings, an embodiment of the present invention will be described hereunder.

Figure 2:
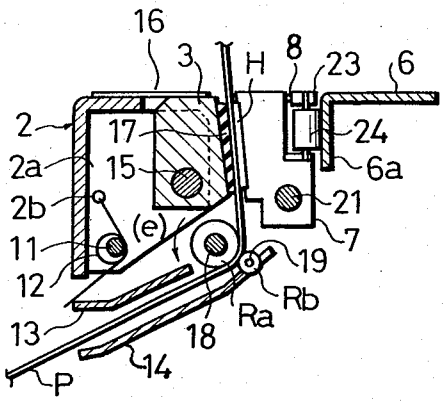
FIG. 2 is a cross-section along II—II line in FIG. 1.
Figure 3:
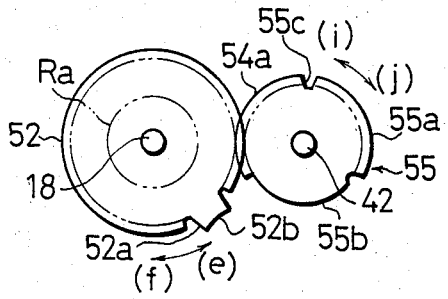
FIG. 3 a diagram showing the power transmission portion of the paper feed apparatus when viewed in the arrow direction III in FIG. 5(A)

FIG. 1 is a plan view showing the outline of a thermal printer which is an embodiment of the present invention, FIG. 2 is a cross-section along II—II line in FIG. 1, and FIGS. 3 et seq. are diagrams showing the paper feed apparatus and the power transmission mechanism for the paper feed apparatus.

Schematic Arrangement of the Printer

A base (now shown) of this printer is formed by thin plate working, etc. A platen support plate 2 and a platen 3 are provided at the forward portion above the base. The platen support plate 2 is supported between a left side plate 4 and a right side plate 5 which are integrally formed with the base. A carriage guide plate 6 is provided at the rear portion above the base. The carriage guide plate 6 is in opposition to the platen 3 with a predetermined distance therebetween. A carriage 7 is movably provided between the platen 3 and the carriage guide plate 6 and a thermal head H is held by the carriage 7 opposite to the platen 3. The carriage 7 is pulled by a wire 8 to move in the direction along the platen 3. On the outer surface of the left side plate 4 are a head displacing mechanism for pulling the wire 8 and a power transmission mechanism 9 for transmitting the operation of the head displacing mechanism to a paper feed apparatus. On the outer surface of the right side plate 5 is a paper feed apparatus 10 which constitutes the characterized portion according to the present invention and which transmits the power from the transmission mechanism 9 to a paper feed roller intermittently.

As shown in FIG. 2, the platen support plate 2 is formed by thin plate working to have an L-shaped cross-section, and the opposite ends of the platen support plate 2 are bent substantially at a right angle to form fitting portions **2*a* thereat. These fitting portions 2*a* are rotatably supported by the side plates 4 and 5 with axles 11. The axles 11 are externally provided with springs 12 respectively so that the platen support plate 2 is urged to the right of the drawing by the elastic force of the springs 12. Upper and lower paper guide plates 13 and 14 opposing each other are provided below the platen support plate 2, and an insertion path for recording paper P is formed betwen the upper and lower guide plates 13 and 14**.

A platen shaft 15 is provided between the fitting portions **2*a* and 2*a*** at the opposite ends of the platen support plate 2, and the lower portion of an above-mentioned platen 3 is rotatably supported on this platen shaft. 15. A plate spring 16 is fixedly attached on the upper surface of the platen 3 such that the tip end of the plate spring 16 is in contact with the upper surface of the platen support plate 2. When the platen 3 is urged to the left in the drawing by the pressing force of the thermal head H, this plate spring 16 is subject to elastic deformation to absorb the pressure of the head. An elastic auxiliary membe 17 is provided on the front surface of the platen 3. As shown in FIG. 2, a paper feed roller Ra and a pinch roller Rb in contact with the paper feed roller Ra are provided at a lower portion of the platen 3. The paper feed Ra is fixedly attached to a paper feed shaft 18 which is rotatably supported by the left and right side plates 4 and 5. The pinch roller Rb is fixedly mounted on a shaft 19 which is supported by the above-mentioned lower paper guide plate 14, and is urged by a plate spring or the like against the paper feed roller Ra to sandwich the recording paper therebetween.

The thermal head H is held on the front surface of the carriage 7 as described above. A guide shaft 21 is provided between the left and right side plates 4 and 5, and a lower portion of the carriage 7 is slidably mounted on the guide shaft 21. A shaft 23 is vertically provided at the rear portion of the carriage 7 and a pressure roller 24 is integrally provided on the shaft 23. The pressure roller 24 is rotatably supported by the carriage 7.

As shown in FIG. 2, the carriage guide plate 6 is bent by thin plate working to provide an L-shaped cross-section. As shown in FIG. 1, this bent portion, that is the central portion of the surface facing the platen 3, forms a pressure surface 6*a* facing the platen 3 with a narrow gap therebetween. At the left end of the bent portion, a bent relief portion 6*b* is formed in opposition to the platen with a wide gap therebetween. Similarly, also at the right end of the bent portion, another bent relief portion 6*c* is formed. When the carriage 7 is in the central position and the pressure roller 24 is sliding on the pressure surface 6*a*, the carriage 7 is pressingly sandwiched in a narrow gap between the platen 3 and the pressure surface 6*a* and the thermal head is pressed against the platen 3. When the carriage 7 is positioned at the relief portion 6*b* or 6*c*, the pressing force on the pressure roller 24 and on the thermal head H is removed.

The left end of the wire 8 fixed to the carriage 7 is entrained around a small pulley 32 supported by the left side plate. The right end of the wire 8 fixed to the carriage 7 is entrained around an idle pulley 31 supported by the right side plate 5, then passes below the carriage guide plate 6, and is entrained around a small pulley 33 on the left side plate 4. A tension setting spring 34 is provided at the midway portion of the wire 8 positioned below the carriage guide plate 6. The wire 8 entrained around the two small pulleys 32 and 33 is wound on a bobbin 35 and fixed. The bobbin 35 is rotatably supported by a shaft 36 on the left side plate 4 (see FIG. 5(B)). At the base portion of the bobbin 35, a gear 35*a* is integrally formed and engages with a pinion 38. The pinion 38 is fixedly mounted on a drive shaft of a pulse motor (not shown) fixedly mounted inside the left side plate 4.

Structure of Paper Feed Apparatus

Figure 5A:
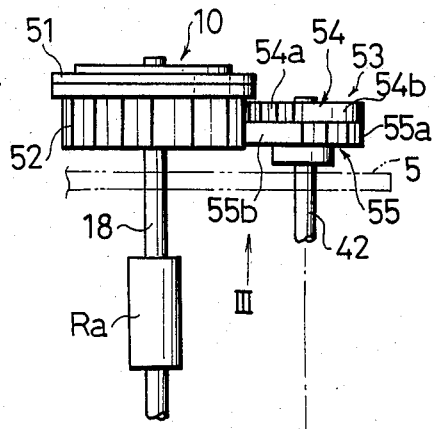
FIG. 5(A) is a plan view showing the power transmission mechanism of the paper feed apparatus.
Figure 4:
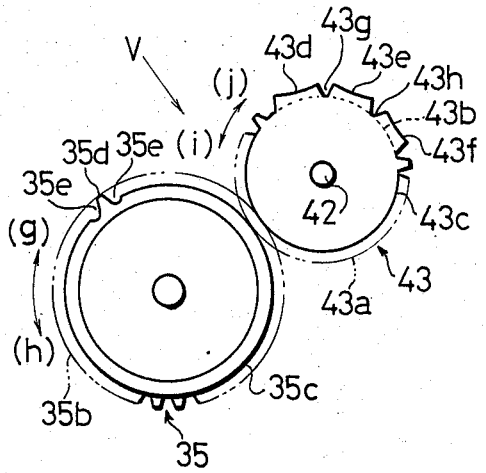
FIG. 4 is a front view of the power transmission mechanism for transmitting the displacement force of the carriage to the paper feed apparatus.
Figure 5B:
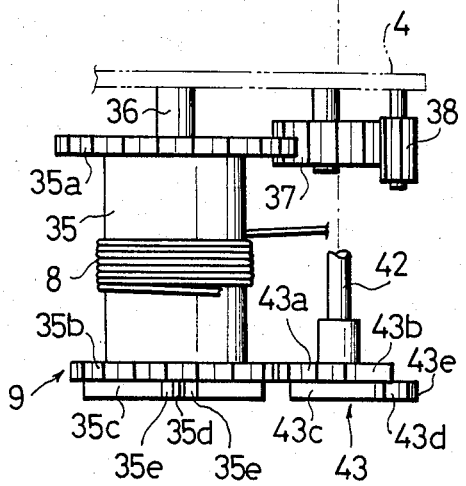
FIG. 5(B) is a diagram when viewed in the arrow direction V in FIG. 4.

The structure of the paper feed apparatus is shown mainly in FIGS. 3, 4, 5(A), and 5(B). FIG. 3 is a diagram viewed in the arrow direction III in FIG. 5(A), and FIG. 5(B) is a diagram viewed from the arrow direction V in FIG. 4. The paper feed roller Ra is fixedly attached on the paper feed shaft 18. A portion of the paper feed shaft 18 extending from the right side plate 5 is provided with a clutch 51, utilizing such as a ball clutch, so that the paper feed shaft 18 is connected to a driven gear 52 through the clutch 51. When a rotation force is applied to the driven gear 52 in the arrow direction (f) in FIG. 3 no power is transmitted from the driven gear 52 to the paper feed shaft 18 through clutch 51. When a rotation force is applied to the driven gear 52 in the arrow direction (e) in FIG. 3, the power is transmitted to the paper feed shaft 18 so that the paper feed roller Ra is rotated in the direction (e) to perform a paper feed operation. A protrusion 52*a* is provided at a portion of the circumference of the driven gear 52. The tip end 52*b* of the protrusion 52*a* is shaped into a concave curvature surface.

Figure 6:
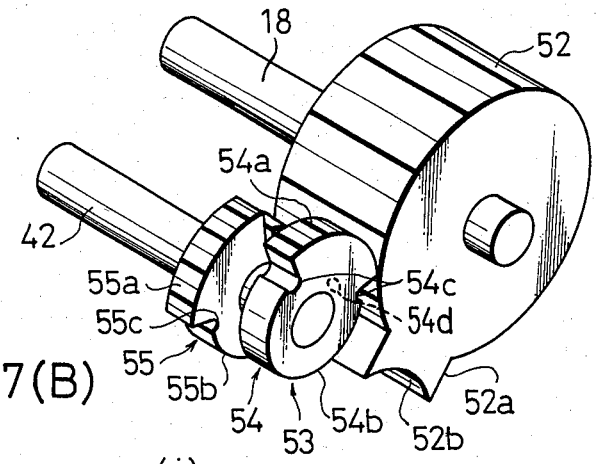
FIG. 6 is a perspective view showing the power transmission portion of the paper feed apparatus.
Figure 7B:
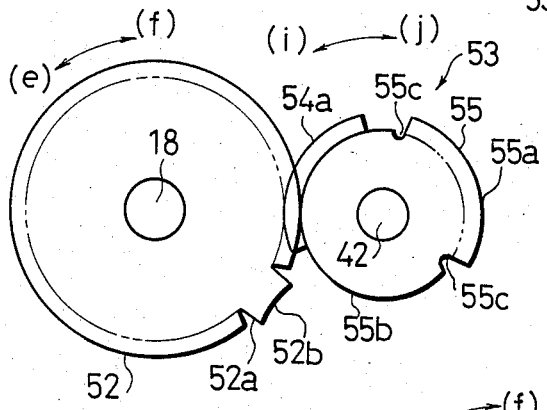
FIGS. 7(A) and (B) are operation explanation diagrams corresponding to FIG. 3.
Figure 7A:
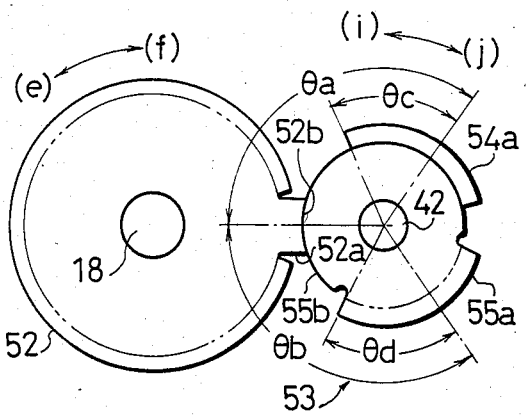

As shown in FIG. 5(A), a drive gear 53 is provided at a position parallel to the driven gear 52. The drive gear 53 is fixedly mounted on an interconnection drive shaft 42. The interconnection shaft 42 is provided between and rotatably supported by the left and right side plates 4 and 5 (see FIGS. 5(A) and 5(B)). The drive gear 53 is constituted by two partially toothed gears 54 and 55. As shown in FIG. 6 ( perspective view ), the partially toothed gear 54 is constituted by a toothed portion 54*a* and a non-toothed portion 54*b* and a release groove 54*c* formed at the boundary between the toothed portion 54*a* and the non-toothed portion 54*b*. Similarly to this, the other partially toothed gear 55 is constituted by a toothed portion 55*a*, a non-toothed portion 55*b*, and a release groove 55*c*. Both the partially toothed gears 54 and 55 are attached onto the interconnection drive shaft 42 by press fitting or by means of screws. By whatever fixing means is employed, the angular position of each of the partially toothed gears 54 and 55 with respect to the interconnection drive shaft 42 can be desiredly set. The non-toothed portions 54*b* and 55*b* of the respective partially toothed gears 54 and 55 are shaped to be circular and the radius of curvature of each of the non-toothed portions 54*b* and 55*b* coincides with that of the concave curvature surface of the tip end 52*b* of the above-mentioned protrusion 52*a*. A differential gear 43 is fixedly mounted on a portion of the interconnection drive shaft 42 projecting from the left side plate 4. This differential gear 43 has a two-stage structure at its inside and outside, and at its inside (the side near the left side plate 4) a toothed portion 43*a* and a non-toothed portion 43*b* formed on the same circumference with the toothed portion are provided. At the outside portion of the differential gear 43, on the other hand, a smoothed portion 43*c* and three protrusions 43*d*, 43*e*, and 43*f* are formed. As shown in FIG. 4, the smoothed portion 43*c* and the toothed portion 43*a* are provided in parallel substantially at the same angles, and the non-toothed portion 43*b* and the three protrusions 43*d*, 43*e*, and 43*f* are provided in parallel substantially at the same angles. A gear 35*b* is formed at the end portion of the bobbin 35. This gear 35*b* is in opposition to the toothed portion 43*b* of the half gear 43 to thereby engage with the toothed portion at the forward portion of the gear 35*b*. A smoothed portion 35*c* is provided which circles about a circumference and a timing tooth 35*d* is formed at a portion of the smoothed portion 35*c*. A pair of grooves 35*e* are formed on opposite sides of the timing tooth 35*d*. The timing tooth 35*d* has the same shape and pitch as the teeth of the gear 35*b*. Each of the respective end surfaces of the three protrusions 43*d*, 43*e*, and 43*f* formed on the differential gear 43 is shaped concave having the same radius of curvature as the smooth portion 35*c*. A groove 43*g* is formed between the protrusions 43*d* and 43*e*, and another groove 43*h* is formed between the protrusions 43*e* and 43*f*. These grooves 43*g* and 43*h* have a shape adapted to engage with the timing tooth 35*d*.

Next, the operation of the thus arranged printer will be described.

Head Displacement and Head Pressing Operation

As shown in FIG. 2, the recording paper P is supplied between the upper and lower paper guide plates 13 and 14 and sandwiched between the paper feed roller Ra and the pinch roller Rb so as to set the recording paper in front of the elastic auxiliary member 17.

Upon energization of a pulse motor, the power of the motor is transmitted through the pinion 38 and the intermediate gear 37 to the gear 35*a* to rotate the bobbin 35. Upon rotation of the bobbin 35 in the arrow direction (g) (see FIG. 4), the carriage 7 is pulled by the wire 8 to the right in FIG. 1. If the bobbin 35 rotates in the arrow direction (h), the carriage 7 moves left in FIG. 1. When the carriage 7 travels on the pressure surface 6*a* at the central portion of the carriage guide plate 6, the pressure roller 24 provided on the carriage 7 rolls on the pressure surface 6*a*. At this time, the carriage 7 is sandwiched and pressed between the platen 3 and the pressure surface 6*a* so that the thermal head is made pressingly into contact with the recording paper P. During the movement of the carriage under this condition, the heat generating points of the thermal head H are selectively energized to thereby print characters, marks, etc., in the dot matrix fashion onto the recording paper P (thermo-sensitive paper).

Power Transmitting Operation

The operation of power transmission and the operation of paper feeding are shown mainly in FIGS. 7(A) and 7(B) (operation diagrams corresponding to FIG. 3) and FIGS. 8(A) to 8(C) (operation diagrams corresponding to FIG. 4 ).

Owing to the provision of the above-mentioned power transmission mechanism 9 and paper feed apparatus 10 (referred to in FIG. 1) the paper feed roller Ra rotates in synchronism with the travelling operation of the carriage 7.

Figure 8A:
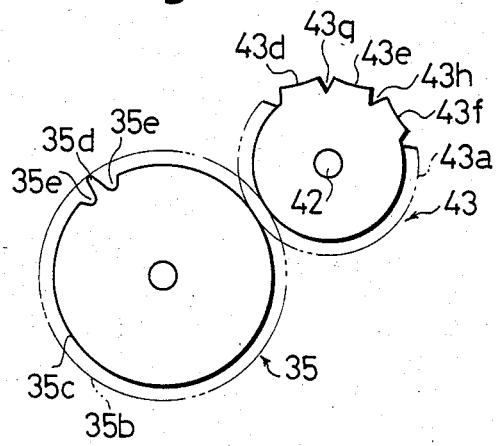
FIGS. 8(A), 8(B), and 8(C) are operation explanation diagrams corresponding to FIG. 4.
Figure 8B:
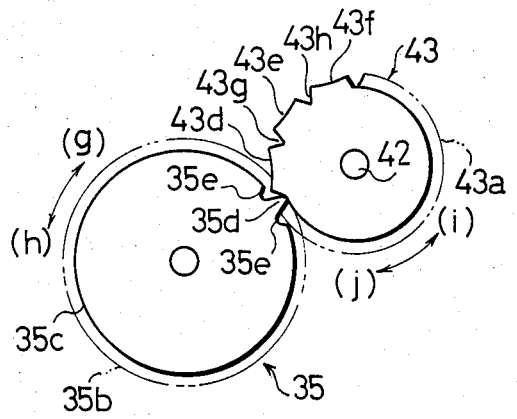
Figure 8C:
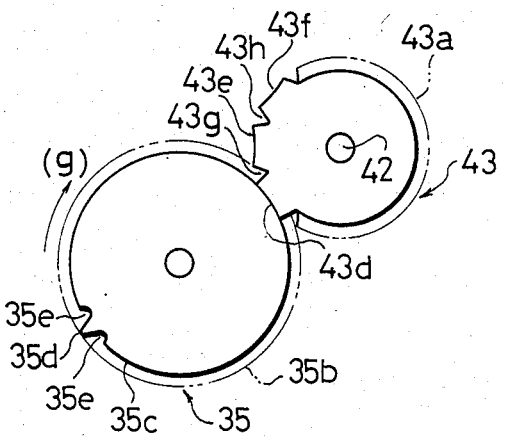

When the carriage 7 is in the position A in FIG. 1, the gear 35*b* at the forward end of the bobbin 35 is engaging with the toothed portion 43*a* of the differential gear 43 as shown in FIG. 8(A). At this time, the toothed portion 54*a* of the partially toothed gear 54 of the drive gear 53 positioned at the outside of the right side plate 5 is also engaging with the driven gear 52. During the displacement of the carriage 7 to the position B in FIG. 1, the bobbin 35 rotates in the direction (g) so that the timing tooth 35*d* on the bobbin 35 reaches the end of the toothed portion 43*a* of the differential gear 43.

Next, the carriage 7 is displaced from the position B in FIG. 1 to the position C, that is the bobbin 35 is rotated from the position shown in FIG. 8(A) in the direction (g), so that the concave curvature portion at the forward end of the protrusion 43*d* of the differential gear 43 is made to slidably contact with the smoothed portion 35*c* at the end portion of the bobbin 35. During the operation from the position of FIG. 8(B) to the position of FIG. 8(C), the angle of the tip end portion of the protrusion 43*d* comes within the groove 35*e* at the side portion of the timing tooth 35*d* (the state shown in FIG. 8(B)), so that the tip portion of the protrusion 43*d* is prevented from eating into the smoothed portion 35*c*. After the state of FIG. 8(C), the rotation of the bobbin 35 in the direction (g) is not transmitted to the differential gear 43 so that the differential gear 43 is stopped.

When the carriage 7 reaches the position D in FIG. 1, the timing tooth 35*d* on the bobbin 35 rotates one round in the direction (g) and engages with the groove 43*g* of the differential gear 43. When the bobbin 35 rotates in the direction (g), the concave curvature portion of the end portion of the second protrusion 43*e* of the differential gear 43 becomes in contact with the smoothed portion 35*c*. Thereafter, when the bobbin 35 rotates in the direction (g), the concave curvature portion at the end portion of the protrusion 43*e* slides on the smoothed portion 35*c* so that the rotation force can not be transmitted to the differential gear 43, similarly to the state of FIG. 8(C). When the bobbin 35 further rotates in the direction (g) and the carriage 7 travels right, the timing tooth 35*d* engages with the second groove 43*h*, and when the bobbin further rotates in the direction (g), the concave curvature surface at the end portion of the third protrusion 43*f* of the differential gear 43 comes into slidable contact with the smoothed portion 35*c*. When the carriage comes back to the position E in FIG. 1, the timing tooth 35*d* engages with the boundary portion between the third protrusion 43*f* and the toothed portion 43*a*.

That is, during the traveling of the carriage 7 from the position B to the position E in FIG. 1, the bobbin 35 rotates three rounds, while the differential gear 43 rotates only by a small angle corresponding to the length of array of the three protrusions 43*d*, 43*e*, and 43*f*.

The carriage 7 is further moved from the position E to the position F in FIG. 1, the timing tooth 35*d* comes out of the end of the third protrusion 43*f* and the gear 35*b* of the bobbin 35 engages with the toothed portion 43*a* of the differential gear 43 so that the rotation force of the bobbin 35 in the direction (g) is transmitted to the differential gear 43 to cause the differential gear to rotate in the direction (i).

On the contrary, when the carriage 7 is turned back from the position F to the position E in FIG. 1, the operation described above is reversed so that the rotation force of the the bobbin 35 in the direction (h) is transmitted to the differential gear 43 to cause the differential gear to rotates in the direction (j).

Thereafter, when the carriage 7 is turned back from the position E to the position B in FIG. 1, only the smoothed portion 35*c* successively comes into slidable contact with the respective concave curvature surfaces of the protrusions 43*f*, 43*e* and 43*d* in the named order, and the differential gear 43 slightly rotates in the direction (j). During turning back of the carriage 7 from the position B to the position A, the gear 35*b* engages with the toothed portion 43*a* to cause the differential gear to rotate in the direction (j) at a predetermined speed.

As described above, in the serial operation of displacement of the carriage 7, when the carriage 7 travels right in FIG. 1, the toothed portion 43*a* of the differential gear 43 engages with the gear 35*b* and rotates in the direction (i) in the respective displacement step from A to B and from E to F. On the contrary, when the carriage 7 travels left in FIG. 1, the toothed portion 43*a* engages the gear 35*b* and rotates in the direction (j) in the respective displacement step from F to E and from B to A. During the traveling of the carriage 7 in the midway between the positions B and E, the smoothed portion 35*e* engages with either one of the protrusions 43*d*, 43*e*, and 43*f* so that the differential gear 43 rotates only a small angle, as described above.

Paper Feed Operation

The rotation of the differerential gear 43 as described above is transmitted to the drive gear 53 through the interconnection drive shaft 42. Accordingly, during the travelling of the carriage 7 to the right end position F from the central position in FIG. 1, the drive gear 53 rotates by an angle $\theta$ a in the direction (i) ( FIG. 7(A) ). Since the toothed portion 43*a* engages with the gear 35*b* when the carriage 7 travels from the position E to the position F, as described above, the drive gear 53 rotates at a high speed in this duration. During the rotation of drive gear 53 by the angle $\theta$ a, at the beginning of this step, the concave curvature end 52*b* of the protrusion 52*a* on the driven gear 53 side is slidably contacting with the respective non-toothed portions 54*b* and 55*b* of the partially toothed gears 54 and 55 (FIG. 7(A)) so that the rotation of the drive gear 53 can not be transmitted to the driven gear 52. When the concave end portion 52*b* of the protrusion 52*a* slides on the non-toothed portions 54*b* and 55*b*, the respective curvature surfaces slide on each other so that the driven gear 52 can not perform independent rotation. If the drive gear 53 rotates in the direction (i) by a predetermined angle, the toothed portion 54*a* of the partially toothed gear 54 engages with the driven gear 52. Since the release groove 54*c* (FIG. 6) is formed at the boundary between the toothed portion 54*a* and the non-toothed portion 54*b* of the partially toothed gear 54, the tip end portion of the protrusion 52*a* comes into this release groove 54*c* when the drive gear 53 rotates, so as to smoothly bring the toothed portion 54*a* into engagement with the driven gear 52. When these toothed portions engage with each other (the state of FIG. 7(B)), the driven gear 52 is driven in the direction (f) within the portion in revolution angle $\theta$c of the drive gear 53. When the portion in the angle $\theta$c of the drive gear 53 is engaging with the driven gear 52, the carriage 7 is in a position in the region between the position E to the position F. At the point when the carriage 7 has reached the position F in FIG. 1. The rotation of the drive gear 53 reaches the limit position of the angle $\theta$a. Thereafter, when the carriage 7 moves left in FIG. 1, the drive gear 53 is driven in the direction (j). At the beginning of the step, that is in the range where the carriage 7 travels from the position F to the position E (in the range of angle $\theta$c), the driven gear 52 engaging the toothed portion 54*a* is driven in the direction (e), and then the forward end 52*a* of the protrusion 52*a* slides on the non-toothed portions 54*b* and 55*b* so that the driven gear 52 stops.

That is, when the carriage 7 travels right, the driven gear 52 rotates in the direction (f) in the step from position E to F, while it rotates in the direction (e) in the step from the position F to the position E (step Yb). When the driven gear 52 rotates in the direction (f), the rotation force thereof is not transmitted through the clutch 51 to the paper feed roller Ra, and on the contrary when it rotates in the direction (e), the rotation force thereof is transmitted to the paper feed roller Ra so as to cause the paper feed roller Ra to send the recording paper upward in FIG. 2.

Similarly, when the carriage 7 travels from its central position to the position A in. FIG. 1, the drive gear 53 is rotated through the interconnection shaft 42 within the angle $\theta$b in FIG. 7(A), by the operation of the above-mentioned power transmission mechanism 9. When the carriage 7 is in a position during its travelling from the position B to A, the toothed portion 43*a* of the differential gear 43 engages with the gear 35*b* so that the drive gear 53 coupled with the differential gear 43 rotates at a high speed. Although the protrusion 52*a* slidably contacts with the non-toothed portions 54*b* and 55*b* at the beginning of the rotation angle $\theta$b, the toothed portion 55*a* engages with the driven gear 55 at the later period (in the range of $\theta$d). That is, during the travelling of the carriage 7 from the position B to the position A, the driven gear 52 rotates in the direction (e), and when the carriage 7 moves right again from the position A, the driven gear 52 rotates in the direction (f). Owing to the function of the clutch 51, the paper feed shaft 18 is driven during the rotation of the driven gear 52 in the direction (e) (during the displacement of the carriage 7 from the position B to the position A (step Ya)) so that the recording paper P is fed upward in FIG. 2.

That is, in this printer, the paper feeding is performed when the carriage 7 moves in the ranges Ya and Yb. At this time, the carriage 7 is positioned at the relief portion 6*b* or 6*c* at the opposite sides of the carriage guide plate 6, and the thermal head H is not caused to press against the recording paper P.

The feeding amount of the recording paper P is determined by the rotation angle of the paper feed roller Ra. Accordingly, the paper feeding amount is determined by the rotation angle of the driven gear 52 which is integrally formed with the paper feed roller Ra. The rotation angle of the differential gear 43 and the interconnection drive shaft 18 driven by the power transmission mechanism 9 is constant and therefore each of the angles $\theta$a and $\theta$b is fixed. Accordingly, the rotation angle of the driven gear 52 in the direction (e) driven by the toothed portions 54*a* and 55*a* can be varied by changing the rotation angles $\theta$c and $\theta$d of the toothed portions 54*a* and 55*a* in FIG. 7(A), so that the rotation angle of the paper feed roller Ra is varied to change the paper feeding amount. Thus, in the stage of assembling or adjustment by the user, the rotation angles $\theta$c and $\theta$d can be changed by changing and thereafter fixing the rotation angles of the respective partially toothed gears 54 and 55 with respect to the interconnection drive shaft 42, thereby desiredly setting the paper feeding amount. In the preferred embodiment, the gear sections 54 and 55 shown in FIG. 6 are press fitted tightly onto shaft 42 so as to be fixed during printing operations. When adjustment is desired, a jig or similar tool is used to turn the grear sections with sufficient torque to the desired angular position. For example, the recesses 54*c* and 55*c* are used as engaging surfaces by a two pronged jig. Alternatively, the gear sections may be adjusted by loosening and tightening a set screw 54*d*, shown in phantom lines in FIG. 6.

As described above, according to the present invention, two toothed portions are separately provided on a drive shaft which rotates corresponding to the opposite ends of the displacement range of a carriage, and a driven gear rotating together with a paper feed roller is driven by the toothed portions, so that the paper feeding amount can be desiredly set by setting the mounting angle at the toothed portions with respect to the drive shaft. Accordingly, the invention has an effect to make easy the adjustment of variations in paper feeding amount to compensate for errors in assembling printers, or the manufacturing of printers of varieties which differ in paper feeding amount from each other.

What is claimed is:

1. A paper feed apparatus for a printer comprising a paper feed roller for feeding a recording paper to a platen, a printer head and carriage moveable along a reciprocation path opposed to said platen, a driven gear engageable with said paper feed roller for advancing the paper in successive line feeding, a clutch mechanism for transmitting the rotation of said driven gear in one direction only to said paper feed roller, and a first drive gear engageable with said driven gear and comprising first and second partially toothed gear sections mounted on a drive shaft and engaging with said driven gear, said first partially toothed gear section driving said driven gear in rotation only when said printer head moves through one end zone of the reciprocation path and said second partially toothed gear section driving said driven gear only when said printer head moves through the other end zone of the reciprocation path, so that line feeding for bi-directional printing is effected.

2. A paper feed apparatus as claimed in claim 1 wherein said driven gear is rotated in one end the other directions by a predetermined angle established by said partially toothed gear sections of said first drive gear.

3. A paper feed apparatus as claimed in claim 1 wherein said partially toothed gear sections of said first drive gear are arranged at selected angular positions with respect to said drive shaft and include means for adjusting their angular positions on said drive shaft, in order to obtain a selected amount of line feeding.

4. A paper feed apparatus as claimed in claim 1 having a rotatable drive source connected with said printer head for driving said printer head along said reciprocation path in bi-directional reciprocation, said drive source being rotatable with a second drive gear in one and the other radial directions with the bi-directional reciprocation of said printer head, said second drive gear being engageable with a second driven gear mounted on said drive shaft driving said first drive gear.

5. A paper feed apparatus as claimed in claim 4 wherein said first drive gear is constituted by two separate gear sections each having a toothed portion, a circumferentially curved non-toothed portion and a release groove, each of said gear sections being adjustably mounted on said drive shaft so that said toothed portions are at selected angular positions to effect a selected amount of line feeding.

6. A paper feed apparatus as claimed in claim 5 wherein said driven gear has a protruding section having a concave curvature which coincides with a radius of curvature of the non-toothed portions of said gear sections of said first drive gear, said protruding section corresponding to a length of travel of said printer head between said end zones of said reciprocation path, whereby said driven gear is held non-rotative with respect to said first drive gear when said protruding section is engaged thereby.

7. A paper feed apparatus as claimed in claim 4 wherein said second drive gear has a non-toothed portion and said second driven gear is fixedly mounted on said drive shaft, said second driven gear having a protruding portion having a concave curvature which coincides with a radius of curvature of the non-toothed portion of said second drive gear of holding said second driven gear non-rotative over a length of travel of said printer head between said end zones of said reciprocation path.

* * * * *